US011578468B1

(12) United States Patent
Kramps

(10) Patent No.: US 11,578,468 B1
(45) Date of Patent: Feb. 14, 2023

(54) ANTI-RAM CRASH-RATED BOLLARD

(71) Applicant: RELIANCE FOUNDRY, Surrey (CA)

(72) Inventor: Shane Kramps, Surrey (CA)

(73) Assignee: Reliance Foundary, Surrey (CA)

( * ) Notice: Subject to any disclaimer, the term of this patent is extended or adjusted under 35 U.S.C. 154(b) by 0 days.

(21) Appl. No.: 17/830,684

(22) Filed: Jun. 2, 2022

(51) Int. Cl.
*E01F 15/00* (2006.01)

(52) U.S. Cl.
CPC ..... *E01F 15/003* (2013.01)

(58) Field of Classification Search
CPC ..... E01F 15/00; E01F 15/003
USPC ..... 404/6
See application file for complete search history.

(56) References Cited

U.S. PATENT DOCUMENTS

| | | | | |
|---|---|---|---|---|
| 4,576,508 | A | 3/1986 | Dickinson | |
| 4,577,991 | A | 3/1986 | Rolow | |
| 4,715,742 | A | 12/1987 | Dickinson | |
| 4,919,563 | A | 4/1990 | Stice | |
| 6,099,200 | A | 8/2000 | Pepe | |
| 6,702,512 | B1 | 3/2004 | Reale | |
| 7,052,201 | B2 | 5/2006 | Zivkovic | |
| 7,607,856 | B2 * | 10/2009 | Patel | E01F 15/003 404/6 |
| 7,699,558 | B2 | 4/2010 | Alder | |
| 7,775,738 | B2 * | 8/2010 | Darcy | E01F 13/12 404/6 |
| 7,850,391 | B2 * | 12/2010 | Omar | E01F 13/12 404/6 |
| 8,197,156 | B2 * | 6/2012 | Morgan | E01F 13/12 404/9 |
| 8,215,865 | B2 | 7/2012 | Crawford | |
| 9,683,340 | B2 * | 6/2017 | Sicking | E01F 15/003 |
| 11,124,934 | B2 | 9/2021 | Beason | |
| 11,174,606 | B1 | 11/2021 | Lamore | |
| 2008/0112756 | A1 | 5/2008 | Omar | |
| 2009/0028638 | A1 | 1/2009 | Crawford | |
| 2009/0035061 | A1 | 2/2009 | Crawford | |
| 2010/0322707 | A1 * | 12/2010 | Darcy | E01F 13/12 404/6 |

FOREIGN PATENT DOCUMENTS

| | | | | |
|---|---|---|---|---|
| GB | 2485278 A | * | 5/2012 | E01F 13/12 |
| GB | 2582789 A | * | 10/2020 | E01F 13/00 |

* cited by examiner

*Primary Examiner* — Gary S Hartmann
(74) *Attorney, Agent, or Firm* — Adam Warwcik Bell; Matthew Kaser

(57) ABSTRACT

A ram-resistant bollard system for prevention of ingress of vehicles onto a sensitive area that will completely stop a 15000 lb. truck, travelling at 30 mph in less than 3.3 ft wherein the bollard system comprises an upright element inserted into a base-plate which is secured onto a foundation structure made from two H-beams each made from a one-piece extruded metal form, wherein the two H-beams are connected to each other via at least one lower connector plate, partially overlapping and connected to the flanges on the lower surface of both H-beams, and wherein the base-plate is positioned above the flanges of the upper surface of the two H-beams, so as to be to be partially overlapping and connected to the top side of both H-beams via a plurality of small rectangular connection plates that are orthogonally positioned between the base-plate and the flanges of the H-beams.

16 Claims, 9 Drawing Sheets

17

Fig. 8 (Prior art, Omar Fixed Bollard System)

(Prior art, Omar 'Fixed Bollard System')

(Prior art, Crawford 'Bollard system and method of installation')

ANTI-RAM CRASH-RATED BOLLARD

STATEMENT OF SUPPORT

This invention was made with the following US government support: None

RELATIONSHIP TO OTHER APPLICATIONS

None

FIELD OF THE INVENTION

The invention relates to security devices to prevent ingress of vehicles onto a sensitive area, for example to prevent a heavy vehicle travelling at high speed from being driven beyond a perimeter picket area into a heavily populated area and thereby preventing accidental or intentional destruction and death. Specifically, the invention relates to bollards that meet The American Society for Testing and Materials standard ASTM F2656.

BACKGROUND

The problem that the invention addresses is as follows. Errant vehicles can cause untold damage upon impact with a building and its occupants. Vehicle ram-raids are also a security concern for stores and the customers. Terrorist attacks are also a threat for high-profile buildings and locations, such as government or financial buildings, or buildings that accommodate a large number of people. Protective perimeters like anti-ram material and products are needed to protect the building and the people inside.

The Currently Used Solution(s)

Different types of bollards are used to protect the building from vehicle ramming but some of their designs and materials used are not strong enough to withstand the heavily impact from vehicles at high speed. The American Society for Testing and Materials has developed a standard, ASTM F2656, used to certify bollards that could withstand the from the ramming of various types of vehicles at different speeds.

The Shortcomings/Disadvantages with the Current Solutions

Bollards that are not certified according to ASTM F2656 cannot promise definite resistance and safety to the building and people they are protecting from. Current designs and making of bollards that meet the standard are complex and add to a lot of material and procedural cost to the products and causing them unaffordable to consumers.

The Need for the Invention

There is a need for an improved security barrier for use in stopping the movement of vehicles, particularly a bollard that meets the standards of ASTM F2656, is relatively inexpensive to manufacture because it is made out of readily-available pre-fabricated components, is easy to install, and may be installed at a shallow depth that does not disrupt underground utility cables and pipes. There is a need for a bollard design that uses industrial existing standard H-beams as core supportive structure to the upright bollard which integration reduces customized material and fabrication costs, and there is a need for a bollard which is adapted to be installed to a depth of no more than 700 mm below grade.

RELEVANT ART

Various security devices employed to control access to entranceways have been proposed. Often found are articulating devices, which consists of an arm or barrier that is pivotally connected to a hydraulic base. The arm or barrier when employed is then raised from a horizontal blocking position to a vertical open position. U.S. Pat. No. 4,858,328 issued to Ellgass is one such device. A disadvantage of such devices is that they are not of reinforced construction and as such cannot arrest the movement of a vehicle. Additionally, such devices are exposed above ground making them subject to vandalism and excessive damage from vehicles hitting them and therefore require frequent repair or replacement.

U.S. Pat. No. 4,576,508 issued to Dickenson is described as an anti-terror barricade capable of stopping the movement of vehicles. This art employs a below the surface bollard raised by a hydraulic lift mechanism. The hydraulic lift mechanism is activated through an electrical control system. Underground environmental exposure to a subterranean electronic device and subterranean hydraulic system is undesirable. Maintenance for hydraulic systems is also very extensive and expensive. Operation based upon two dependent power sources (electrical power and hydraulic power) degrades reliability.

U.S. Pat. No. 4,715,742 issued to Dickinson is also an anti-terror barricade intended to stop the movement of vehicles. This below the surface bollard is raised by the stored energy of a metal coil compression spring. The coil spring is released and locked through an electronically or manually engaged bolt. The bolt and the control box, which houses the bolt, are recessed just below grade level. Access to the control is through a locked cover. Both the bolt and the cover to the control box are located too close to the surface and could result in sabotage or vandalism to the device. This device is further disadvantaged in that it relies on a single spring as a lift mechanism and additionally since it can be manually raised it is inherently of lighter construction.

U.S. Pat. No. 4,577,991 issued to Rolow is a vehicle barricade apparatus for arresting the movement of vehicles. These devices as well as the two Dickinson patents above are disadvantaged in that they are intended to be employed instantaneously in the event of a terrorist attack. They are dependent upon the decision of a human to activate the device and are all dependent upon a single lift means without a redundancy capability.

Other prior art include systems that employ bollards encased below the surface. U.S. Pat. No. 4,919,563 issued to Stice and U.S. Pat. No. 5,476,338 issued to Alberts are exemplary of this art. The Stice and Alberts devices are relatively complicated employing a worm gear/screw.

U.S. Pat. No. 6,702,512, 'Vehicle arresting installation' describes an invention as follows. A car or other vehicle is prevented from crashing through a barrier along a driveway or other path. One or more bollards stands in the path, on a support in a recessed box that is flush with the surface and defines a pivot axis perpendicular to the path of the vehicle. The bollard can be temporarily detachable to permit passage. A vehicle striking the bollard pivots the bollard backward on the axis, preferably into a clearance space provided. Elongated pike structures are coupled to the bollard and are pivoted up from the surface at an acute angle, to pierce and arrest the vehicle. The pikes can be structural bars, for example of angle iron with flanges formed to barbed points. Preferably several pikes are provided, of which some are angularly fixed relative to the bollard and others are rotatable up to a maximum angle at which the pikes become angularly stopped, for example by engagement with the adjacent pikes. The pikes thus are deployed in a bristling array that engages with the vehicle. The support can have a breakaway attachment with the box, causing the pike array to roll under and progressively to impale the vehicle. This retards the vehicle and precludes effective control by the driver.

U.S. Pat. No. 6,099,200 'Anti-terror bollard' describes an invention as follows. The device consists of a reinforced telescoping bollard inserted into a foundation casing which is imbedded below ground. The device is manually operated and is extended by a self-contained gas-charged spring lift mechanism. The device contains a locking mechanism for securing the telescoping bollard in the extended and retracted positions. When in the retracted position the bollard is flush with the surface and can be traversed by a vehicle. The device is of simple design, easily installed and easily maintained.

U.S. Pat. No. 7,052,201 'Safety bollard' describes an invention as follows. A safety bollard, post or stanchion to protect adjacent a vehicular area, each bollard, post or stanchion being so designed to provide a progressively increasing resistance to bending and/or deformation on impact by a vehicle, whereby the force of impact is progressively absorbed by the bollard, post or stanchion and deformation of the vehicle whereby the vehicle is progressively decelerated.

Other prior art includes the following: U.S. Pat. No. 11,174,606 Shallow-mount, stand-alone security bollard; 2007086858 Shallow mounted fixed vehicle barrier device; U.S. Pat. No. 8,215,865 Anti-ram system and method of installation; 7699558 Anti-ram system and method of installation; 2012308302 Anti-ram system and method of installation; and U.S. Pat. No. 11,124,934 Bollard assembly with stress control device.

Additionally, the following US applications/patents may be relevant:

2008/0112756 'Fixed bollard system' to Omar, describes:

"A fixed bollard system includes a plurality of spaced apart, elongated bollards each longitudinally disposed along a corresponding X-axis, each bollard being comprised of an I-beam having a front face and an opposing back face extending between a top end and an opposing bottom end. A plurality of horizontal support beams are each longitudinally disposed along a corresponding Y-axis, each horizontal support beam being comprised of an I-beam and having a first end and an opposing second end, the first end of each horizontal support beam being connected to the back face of a corresponding bollard at the bottom end thereof. An elongated lateral front beam connects to the front face of each of the plurality of bollard at the bottom ends thereof. An elongated lateral rear beam connects to the second end of each of the plurality of horizontal support beams."

This fixed bollard system of Omar is very different from the present invention and lacks many of the main elements of the present invention. The design and the purpose of the design and the result of the design are all different. Omar does not show, disclose or suggest all the structural elements of the present invention, neither would there be a reasonable expectation of success because the design of Omar fails to provide the structural resilience provided by the present invention.

Specifically, in Omar's design, to achieve strong impact resistance, Omar's design requires an array of bollards with a front-end I-beam opposed to a back-end I-beam. See FIG. 8 and FIG. 9 that show the prior art invention of Omar. In Omar, each bollard 14 comprises a vertical support beam 40 (which may be an I-beam but more commonly, a wide flange beam (W-beam) having a nominal size of about 10 inches by 10 inches. The vertical support beam 40 attaches to a horizontal support beam 74, and this L-shaped arrangement is fixed between opposing beams 70 and 72.

Omar fails to disclose, mention, discuss or suggest whether a stand-alone bollard with limited length of front end and opposing back-end I-beams can withstand an impact.

In our present invention, however, the H-beams are arranged in such a way as to place the center of gravity of the entire structure is underground and behind the above-ground upright element (1) relative to the crash/vehicle/impact direction. To clarify, looking at FIG. 1, the foundation is in the shape of a letter T. The 'front' of the bollard is defined as the side most closely facing the anticipated vehicle that is going to crash into the bollard and is the top bar of the T. The 'rear' of the bollard is defined as the side diametrically opposite to the front side. In use, the bollard system is placed in the ground such that the front faces the likely source of the impact, and the back faces away from the impact.

The bollard of the invention is designed so that the center of gravity is underground and behind the above-ground upright element (see FIG. 1).

The arrangement allows the bollard to meet crash rated specifications without adding additional weight (and therefore cost) to the structure and without the necessity to dig a deeper foundation. Specifically, the present invention is designed to use a shallow foundation hole to avoid utilities or other underground obstacles. This is a very important aspect of the invention because it hugely reduces costs. Our design (M30-SM "shallow mount" bollard) requires 700 mm (27.6") of concrete below grade, while our "non-shallow mount" bollard needs only 900 mm (35.4"). To clarify, our design (M30-SM) is adapted to be installed no more than 700 mm below grade, and our "non-shallow mount" system is adapted to be installed no more than 900 mm (35.4") below grade. Thus, the total depth of the bollard system below the ground may be 700 mm in one embodiment or 900 mm in another embodiment.

In other embodiments it may be beneficial to make a bollard adapted to be installed no more than the following depths below grade, for example: 400 mm, 500 mm, 600 mm, 700 mm, 800 mm, 900 mm, 1000 mm, 1200 mm or 1500 mm.

Our present bollard system is much better than the comparable prior art with similar performance because not only does it meet and exceed, ASTM F2656, completely stopping a 15000 lb. truck, travelling at 30 mph in less than 3.3 ft., but it is it cheaper to manufacture and easier to install because it is above many utilities, and can be installed as an individual bollard at any location.

In the present invention, each individual bollard can stand alone to withstand impact from hostile vehicles ranging from a small passenger car to up to 15,000 lbs. standard truck impacting at 50 MPH. The present design also allows an array of multiple bollards, but is specifically designed to be installed as a single bollard unit. These may be placed in any arrangement required to protect a perimeter of any shape such as straight, curved, obtuse angled, acute angled, round or on a corner of a target building. Omar is incapable of achieving this flexibility because the bollard system of Omar must be made in a straight line.

Importantly, Omar suggests a fixed bollard system comprising a plurality of vertical support beams 40. The present invention discloses an individual, stand-along bollard, not connected to any other bollard.

Also importantly, a weak point of the Omar system is due to the vertical support beams 40 being fixed to the horizontal support beam 74, and between an opposing beam 70 and 72 near the bottom end of the vertical support beam. When the upright is struck by a moving vehicle, this has the effect of providing a strong levering force (Torque) which leads to increased probability of structural failure. T=Fd where T=torque, F=force and d=distance to fulcrum. Thus, for a given force (the car) T is directly proportional to d and increases with distance from fulcrum. In Omar, d is large as a proportion of the distance from fulcrum to the top of the upright bollard, therefore T is amplified. In our present invention, d is much smaller as a proportion of the distance from fulcrum to the top of the upright bollard, and therefore T is relatively much less.

Specifically, in one embodiment the upright element (1) is inserted into and passing through a base-plate (6) such that at least 20% of the length of the upright element is present below the base-plate. In another the upright element (1), inserted into and passing through a base-plate (6) such that at least 31% of the length of the upright element is present below the base-plate. Of course, other are possible, for example at least 20%, at least 25%, at least 30%, at least 35%, at least 40%, at least 45% or even at least 50% of the length of the upright element may be present below the base-plate. In the figures, and in one preferred example which has been tested, the total length of the upright is 63 inches and the length of the upright element above the baseplate is 43 inches, and the length of the upright element below the baseplate is 20 inches. Thus at least 31% of the length is below the baseplate (the fulcrum).

Additionally, Omar does not provide round upright inserted into and passing through a hole in a baseplate and fixed to the baseplate (6) by welding and additionally fixed by triangular buttresses or similar, and additionally fixed at the bottom of the upright against a metal connector plate (5). Fixing the upright at both point vastly improves the resistance of the upright to being deformed and pushed over due to the huge resistance to torque produced against the bottom of the structure.

Additionally, Omar does not provide round upright or any cut-out for receiving and seating a round upright tube against an H-beam, as does the present invention.

Additionally, Omar does not provide a bollard using a hollow upright tube reinforced with a longitudinal internal crossbar.

2009/0028638 'Bollard System and Method of Installation' to Crawford, and in exactly the same way as describes an anti-ram bollard assembly and an installation of the same to arrest impacts. This invention mentions H-beams once in the specification and includes a system wherein the base assembly 20 may comprise one or more I-beam (or H-beam) cross-section arrangements, which in turn comprise a top plate 22, a bottom plate 24 and at least one intermediate plate 26 interposed therebetween. This disclosure is different from the present invention and lacks many of the main elements. In Crawford's design, the base assembly 20 is comprised of individual fabricated plates welding together to form an I-beam (or H-beam) shape. It has the I-beam (or H-beam) shape but does not have the strength that a one-piece extruded I-beam (or H-beam) has, such as in the invention.

In the present invention, a pre-existing industry one-piece extruded H-beams are used. The H-beams along with a plurality of steel buttresses welded to connect various parts of the structure such as the upright to the baseplate are employed so as to enhance structural integrity and resistance to vehicle ramming.

2009/0035061 'Removable Bollard System and Method of Installation', also to Crawford, describes an anti-ram removable bollard assembly and an installation of the same to arrest impacts. This application has a similar or identical specification to 2009/0028638 and mentions H-beams once in the specification, and the base assembly 20 also includes a sleeve 40 to receive a removable bollard member, and a coupling mechanism is provided in the sleeve 40 to removably engage a bollard member 10 with the base assembly 20. From paragraph [0022] "The base assembly 20 includes at least one I-beam (or H-beam) cross-section arrangement. The I-beam arrangement comprises a top plate 22, a bottom plate 24 and at least one intermediate plate 26 interposed therebetween. The intermediate plates 26 may be fixedly attached to the top and bottom plates 24, such as by welding, to support the top and the bottom plates 24." This disclosure is different from the present invention and lacks many of the main elements. In Crawford's design, the base assembly 20 is comprised of individual fabricated plates welding together to form an I-beam (or H-beam) shape. It has the I-beam (or H-beam) shape but does not have the strength that a one-piece extruded I-beam (or H-beam) has. In the design of the present invention, a pre-existing industry one-piece extruded H-beams are used. The H-beams along with a plurality of steel buttresses welded forming the foundation to support upright bollard against from vehicle ramming.

Specifically, neither 2009/0028638 nor 2009/0035061 teach disclose or suggest the present invention with all the features discussed and defined in the claims.

Crawford discloses H-beams only once, and tangentially, and indeed it is clear that the "H-beams" they mention are not at all of the one-piece extruded H-beams used in the present invention.

Specifically, Crawford states:

"The base assembly 20 may comprise one or more I-beam (or H-beam) cross-section arrangements, which in turn comprise a top plate 22, a bottom plate 24 and at least one intermediate plate 26 interposed therebetween. The intermediate plate(s) 26 may be fixedly attached to the top and bottom plates 22, 24 by welding to support the top and the bottom plates 22, 24. In the embodiment of FIGS. 1A and 1B, four intermediate plates 26 are provided in the base assembly 20 and disposed substantially perpendicular to one another. However, it should be appreciated that other number of intermediate plates 26 may be provided and may be disposed at other angles to one another. In the case where only two intermediate plates 26 are provided, the two intermediate plates 26 may be disposed at about 180 degrees with respect to each other. The I-beam arrangement is to provide reinforcement to the base assembly 20. More particularly, the intermediate plate 26 supports the top and the bottom plates 22, 24 to prevent deformation due to static loading prior to impact loading."

Crawford therefore does not suggest using one-piece extruded H-beams.

Crawford (FIG. 10) discloses a bollard assembly including "an I-beam arrangement", but this is not the same as the H-beams of the invention.

Crawford clearly does not disclose the structure of the invention, being an individual, stand-alone bollard comprising: A single upright element (1), inserted into and passing through a base-plate (6) which is secured onto the top surface of a foundation structure, wherein the foundation structure comprises two H-beams (2) and (3) oriented with respect to each other in a T-shape, wherein the two H-beams are placed such that, in situ, the web of each H-beam is in a vertical orientation, and wherein the two H-beams have an upper surface defined by flanges and a lower surface defined by flanges, wherein the two H-beams are connected to each other via at least one lower connector plate (5), which fits flush against the bottom of the foundation structure, partially overlapping and connected to the flanges of the lower surface of both H-beams, and wherein the base-plate (6) is positioned above the flanges of the upper surface of the two H-beams, so as to be to be partially overlapping and connected to the top side of both H-beams via a plurality of small rectangular connection plates (4) that are orthogonally positioned between the base-plate and the flanges of the H-beams.

BRIEF DESCRIPTION OF THE INVENTION

The invention provides an anti-ram crash-rated bollard designed to employ commercially available pre-formed structural elements such as standard H-beams and similar elements to form the core supportive structure to the upright bollard. This integration reduces the necessity for using customized materials and significantly reduces fabrication costs. The design uses a steel crossbeam inside the bollard pipe to improve resistance to impact forces. The design further integrates eyebolts into the structure to provide easy installation.

DETAILED DESCRIPTION OF THE INVENTION

Figure 1:
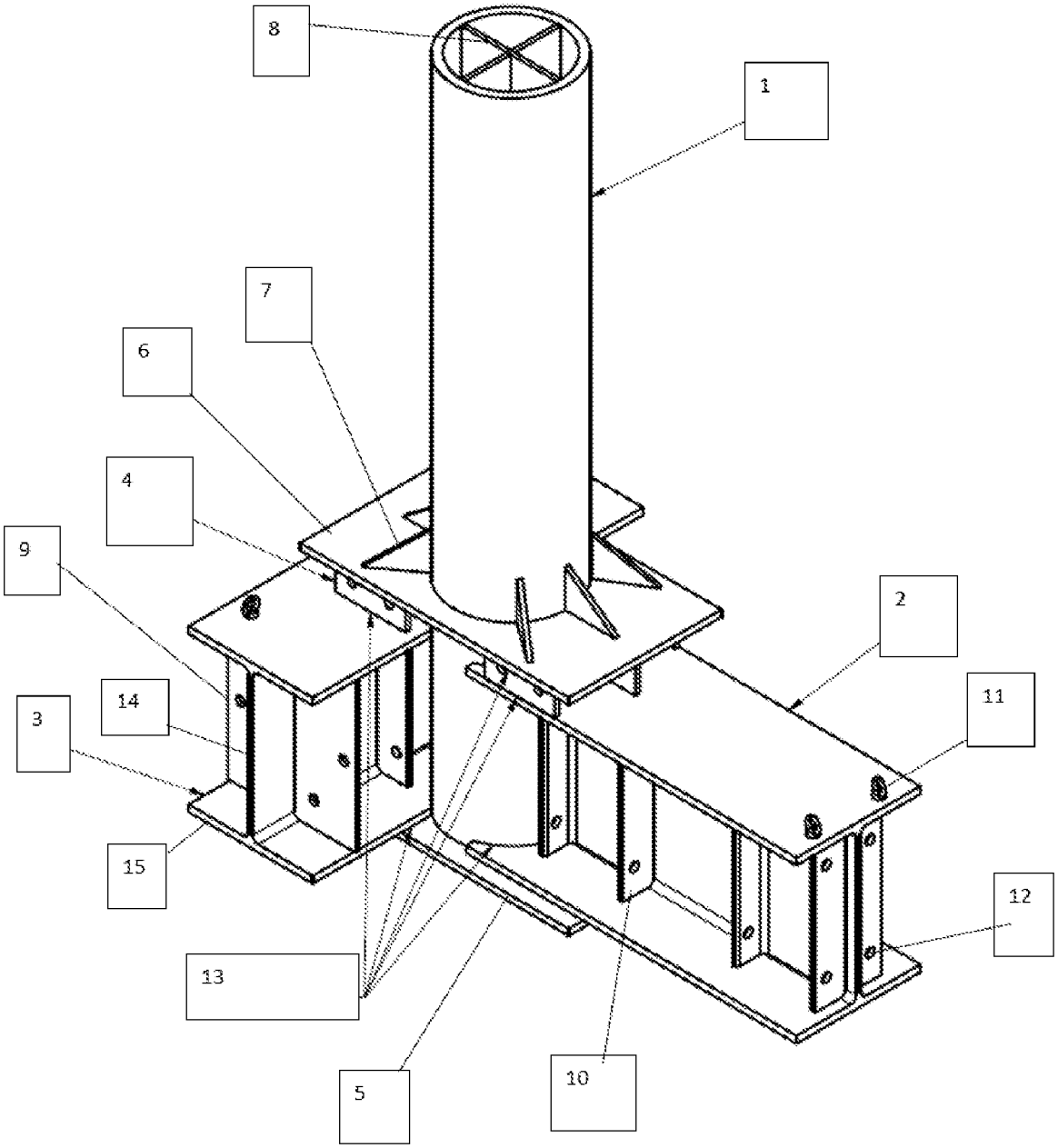
FIG. 1 Perspective view of bollard system, schematic diagram.
Figure 2:
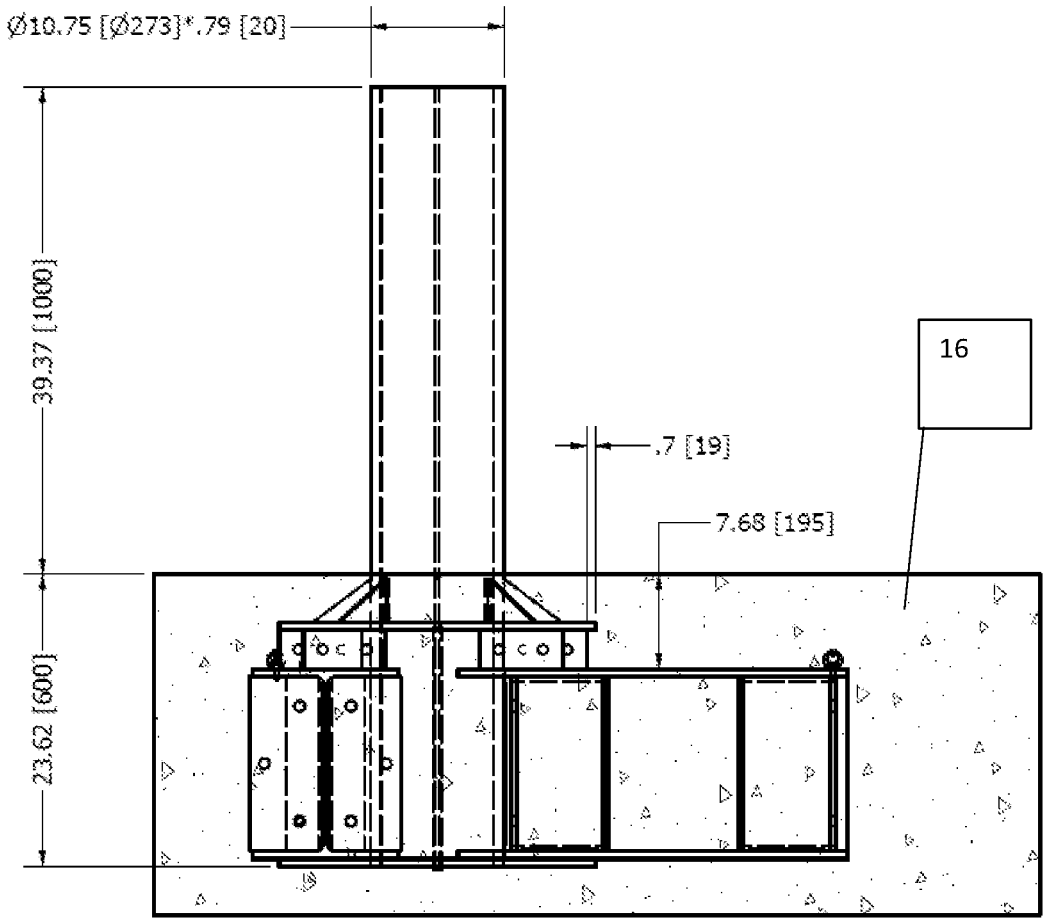
FIG. 2 Side view of bollard system, schematic diagram.
Figure 3:
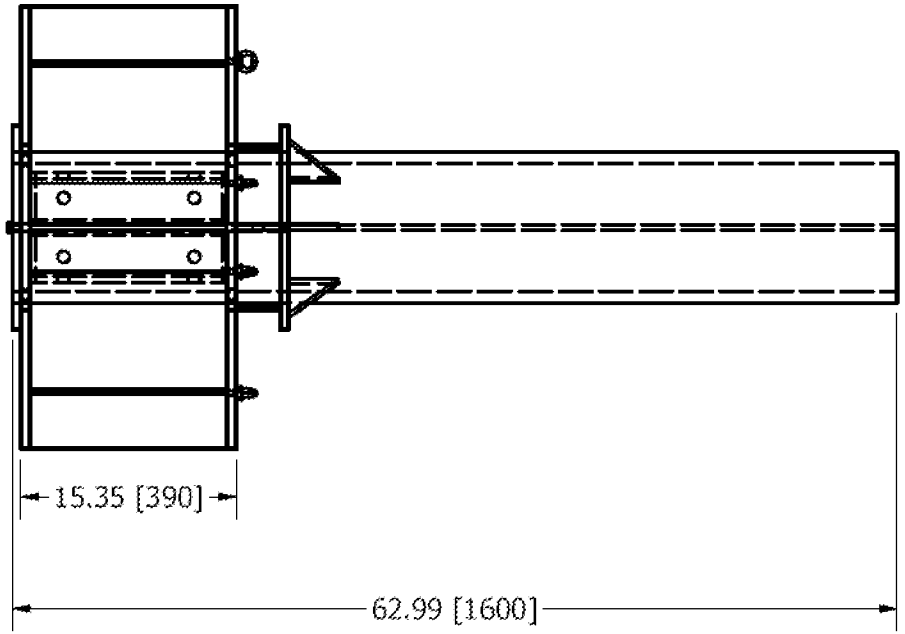
FIG. 3 Front view of bollard system, schematic diagram.
Figure 4:
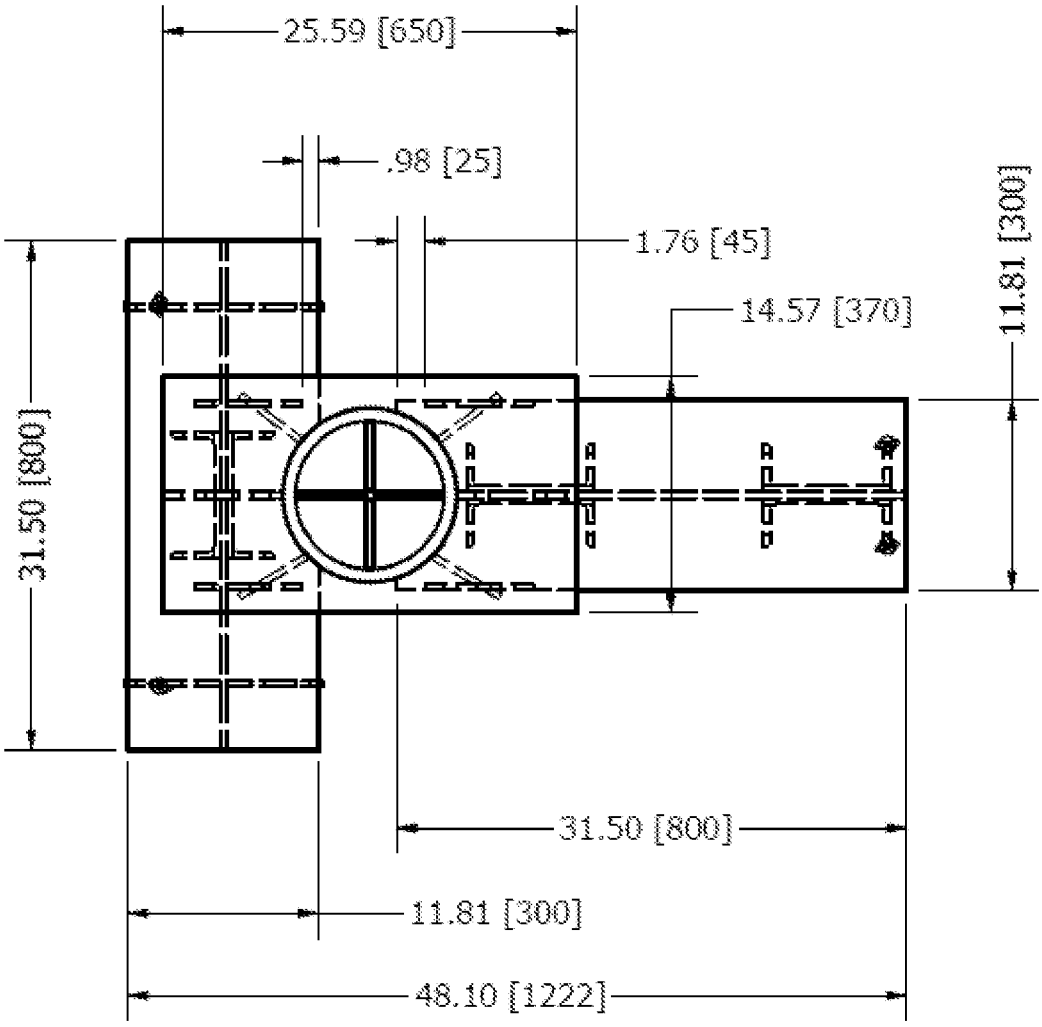
FIG. 4 Top view of bollard system, schematic diagram.
Figure 5:
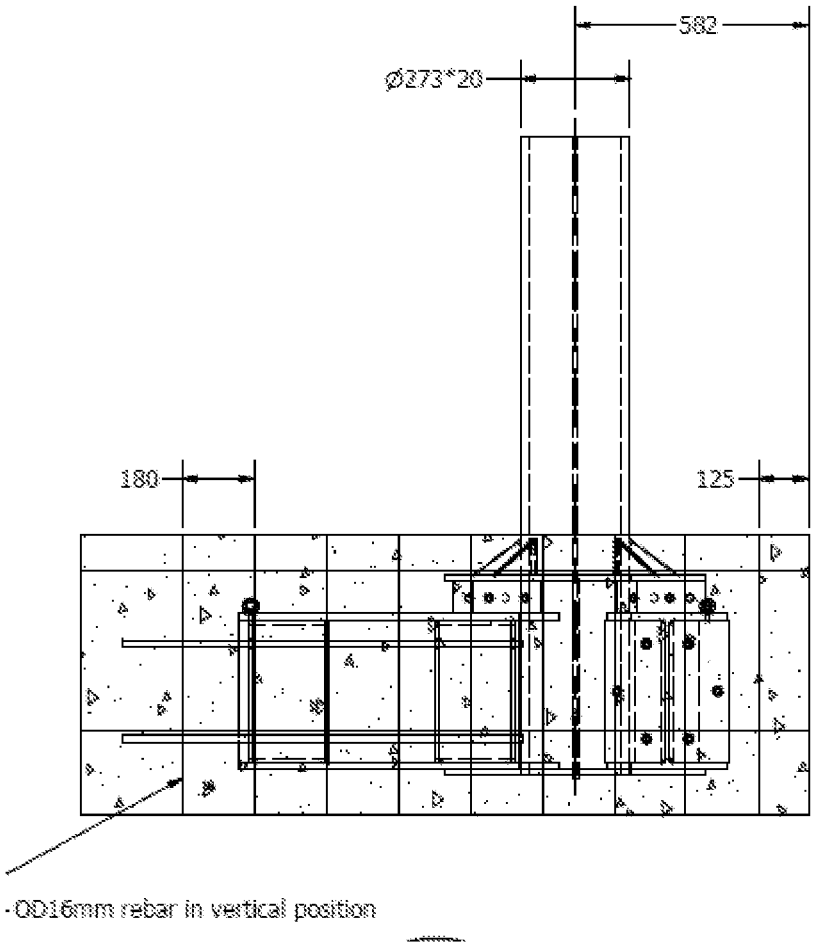
FIG. 5 Side view of bollard system installed in ground, schematic diagram.

Attacks on soft targets, such as buildings or crowds of people, using a vehicle, often combined with gunfire and explosives, has sadly become a well-known tool of terrorism in our modern world.

The present invention addresses this problem and provides a ram-resistant anti-ingress barrier system for prevention of ingress of vehicles onto a sensitive area. For example, the bollard of the invention may be used to prevent a heavy vehicle travelling at high speed from being driven beyond a perimeter picket area into a heavily populated area and thereby preventing accidental or intentional destruction and death.

Specifically, the invention relates to bollards designed to decelerate a vehicle impacting said bollard, and to stop it within a certain set distance. More specifically the bollard of the invention provides a thoroughly tested and proven anti-ram crash-rated bollard system that meets The American Society for Testing and Materials standard ASTM F2656, and which is highly effective, has a relatively low cost of construction and installation because it is made with pre-formed, commercially available parts, and includes integrated elements for installation.

The design of the bollard of the invention is adapted to produce superior ram resistance while concomitantly reducing manufacturing costs. The present design employs commercially available pre-formed structural elements. The invention uses standard H-beams (2) and (3), or similar, to form the core supportive structure (may be referred to herein as the "foundation structure") that is embedded into the ground and used to support the upright bollard element that projects above the ground. This intentional integration of commercially available structural elements reduces use of customized material, reduced the need for welding and/or bolting parts together, and thereby reduces fabrication costs.

The upright bollard element may be referred to as the "bollard pipe" (1) and in one embodiment is formed in the shape of a crosssectionally round pipe. However, the invention is not limited to this specific shape and the upright bollard element may be of any suitable shape including a crosssectionally square or rectangular or triangular or oval or cross-section other shape.

The bollard system of the invention additionally employs a steel crossbeam (8) inside the upright bollard pipe to improve resistance to impact forces.

As shown in the figures, H-beams (2) and (3) may be welded or bolted (or both) together to produce a strong underground scaffold (the foundation structure). H-beams may be attached together in a parallel or orthogonal orientation to one another. Onto this foundation structure, the upright bollard element (1) is secured, either by bolting or by welding, or both. A square or rectangular or round (or any other suitable shape) plate (a "base-plate") (6) may be secured to the upper surface of the foundation structure to provide the surface onto which the upright bollard (1) element is secured or alternatively, through which the upright bollard element passes, continuing through the base-plate (6), and penetrating into the foundation structure such that the upright element is sandwiched between at least two H-beam elements (2) and (3), providing superior resistance to a force on the above-ground portion of the bollard.

Very importantly, the H-beam(s) of the invention is made from a one-piece extruded form and are not pieced together and welded as in some of the prior art bollards.

Figure 6:
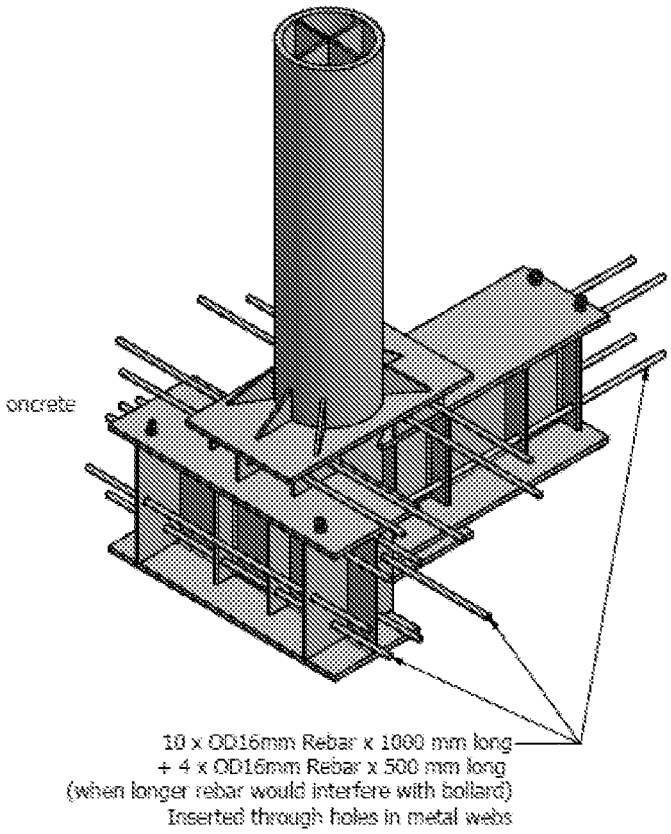
FIG. 6 Perspective view of bollard system as installed with rebar in place.
Figure 7:
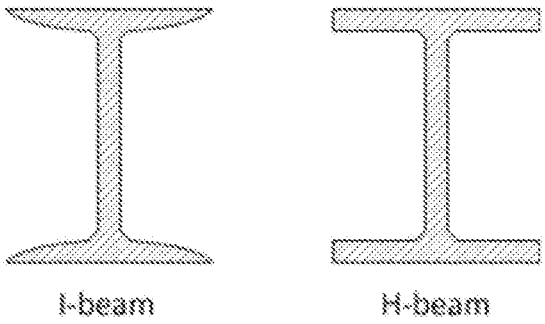
FIG. 7 H-beam and I-beam cross-sectional schematic diagram.
Figure 8:
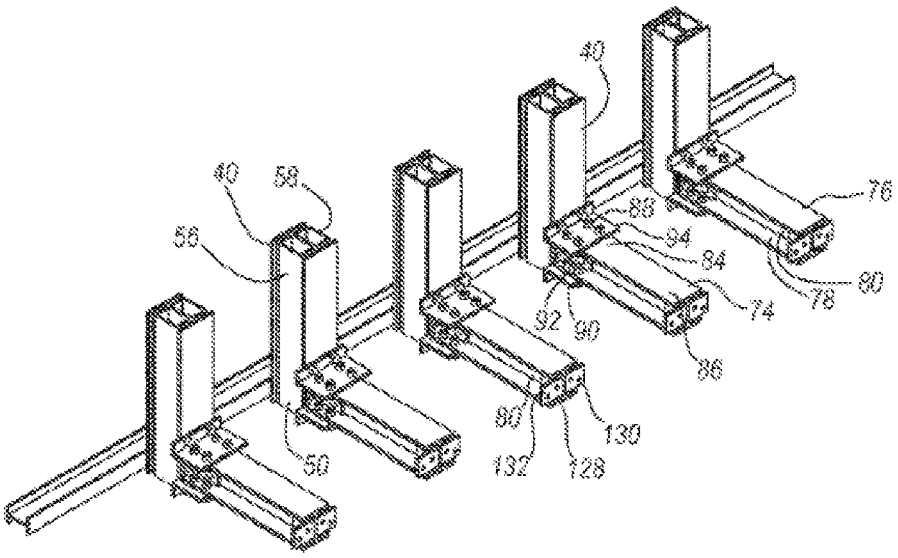
FIG. 8 shows a prior art bollard design to Omar.
Figure 9:
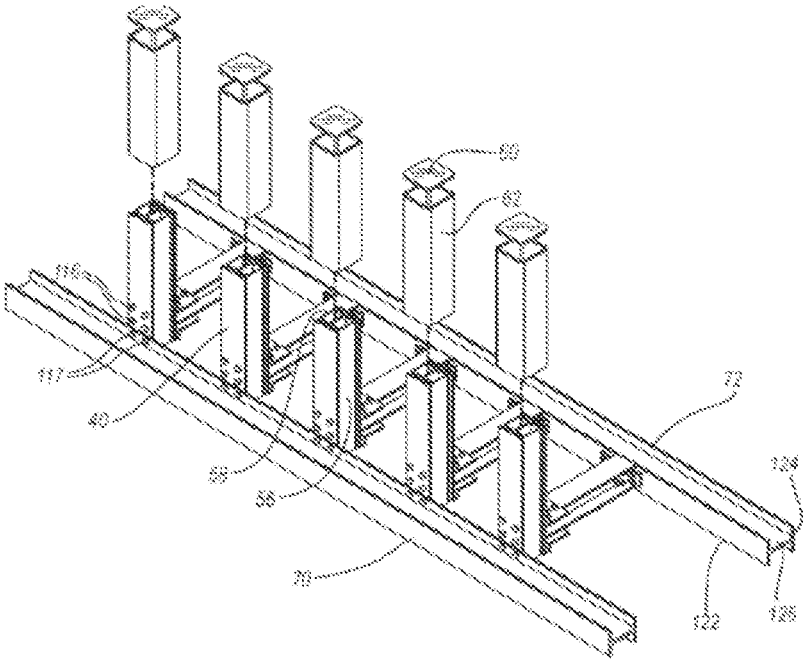
FIG. 9 shows a prior art bollard design to Omar.
Figure 10:
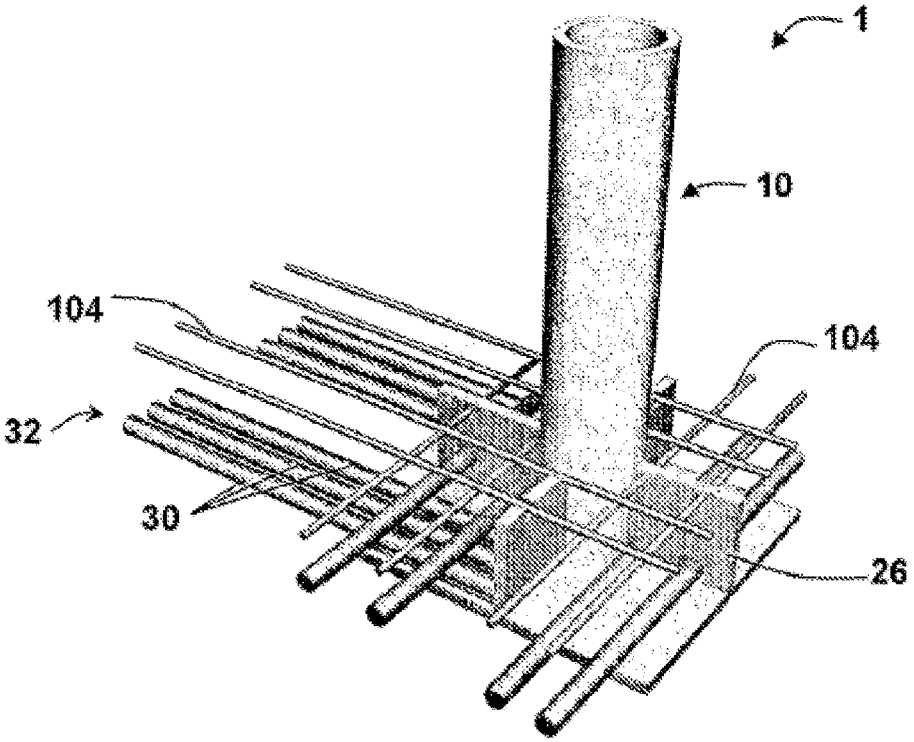
FIG. 10 shows a prior art bollard design to Crawford.

In one embodiment, the end of one of the H-beams is partially cut away to provide a semicircular (or approximately semicircular) shape at one end, adapted to receive the upright element, as shown in FIGS. 1 and 6 where the flanges and the web of the H-beam (labeled as part No. 2 in FIG. 1) is shown to be cut away to provide a semicircular shape and in which the upright element is shown to be seated, attached to the H-beams via lower connector plate 5 on the bottom and base-plate 6 on the top.

The structural elements of the bollard system, that is the H-beams (2) and (3), generally include a plurality of pre-formed eye-holes (12) adapted to receive rebar rods.

In one embodiment the upright element (1) is inserted into and passing through a base-plate (6) such that at least 20% of the length of the upright element is present below the base-plate. In another the upright element (1), inserted into and passing through a base-plate (6) such that at least 31% of the length of the upright element is present below the base-plate. Of course, other are possible, for example at least 20%, at least 25%, at least 30%, at least 35%, at least 40%, at least 45% or even at least 50% of the length of the upright element may be present below the base-plate. In the figures, and in one preferred example which has been tested, the total length of the upright is 63 inches and the length of the upright element above the baseplate is 43 inches, and the length of the upright element below the baseplate is 20 inches. Thus at least 31% of the length is below the baseplate (the fulcrum).

In use, the bollard, comprising the foundation structure and the upright bollard element, is installed into a pre-dug hole, below the grade of the ground. Rebar elements are inserted through a plurality pre-formed eye-holes (12) within the foundation structure. Concrete is then poured around the structure to provide a secure subterranean foundation for the bollard system.

Orientation of the system aids effectiveness as the H-beams are arranged in such a way as to place the center of gravity of the entire structure is underground and behind the above-ground upright element (1) relative to the crash/vehicle direction. To clarify, looking at FIG. 1, the foundation is in the shape of a letter T. The 'front' of the bollard is defined as the side most closely facing the anticipated vehicle that is going to crash into the bollard and is the top bar of the T. The 'rear' of the bollard is defined as the side diametrically opposite to the front side. In use, the bollard system is placed in the ground such that the front faces the likely source of the impact, and the back faces away from the impact. The bollard of the invention is designed so that the center of gravity is underground and behind the above-ground upright element (see FIG. 1). The arrangement allows the bollard to meet crash rated specifications without adding additional weight (and therefore cost) to the structure and without the necessity to dig a deeper foundation.

One embodiment of the design employs a steel crossbeam (8) inside upright bollard element to strengthen the bollard and resist crushing. The crossbeam also acts to maintain a strong connection between the upright element of the bollard (the bollard pipe) and the foundation structure, and therefore to increase resistance to impact force of a speeding vehicle impacting the bollard at any level above the ground (above the grade).

In various embodiments, the design also employs a plurality of steel buttresses (7) attached both to the outer surface of the upright element (1) and to the base-plate (6) of the foundation structure. These buttresses (7) are generally triangular in shape and attached by welds. These are present to further strengthen the connection between the upright element of the bollard (the bollard pipe) and the foundation structure and to add structural strength to prevent bending and deformation of the upright element during impact.

In another embodiment the small triangular buttresses (7) are welded below the base-plate (6) in contact with the vertical element (1) and with the bottom of the base-plate (6).

The design further integrates eyeholes (12) and/or eyebolts (11) into the structure, providing points for attachment of cables for lifting and moving the bollard system thereby providing easy installation.

The invention differs from the prior art bollards in various ways. The overall structural design is unique, comprising an upright bollard element (1), welded or bolted to or passing through a base-plate (6) secured on the top surface of a foundation structure employing one or at least two H-beams (2) and (3) secured to each other in an approximately orthogonal orientation. This greatly adds to structural strength and reduces manufacturing costs. The design integrates architecture-usage H-beams to support bollard strong enough to withstand impact from hostile vehicle. The design includes integrated eyebolts making the installation much easier for onsite workers.

In various embodiments the bollard system of the invention may employ either H-beams or I-beams or other similar structural elements. H-beams and I-beams primarily differ in their cross-sections. Both have a common horizontal part called the "flange" (15) and a vertical part located between the flanges called the "web" (14). If this were a letter H, the flanges would be vertical and the web would be horizontal. H-beams are stronger due to the thickness of the flanges (15). The web resists the shear stresses, and the flanges are made to withstand most of the bending moment coming over the steel beam. H-beams and I-beams are fabricated by milling or rolling steel and made of a single piece of steel.

Alternatively, the flanges may be welded to the web. H-beams are also called wide flange beams. The web of I-beams is thinner than H-beams. H-beams have greater web thickness compared to I-beams. This increased thickness gives strength to H-beams. The flanges of I-beams are tapered with an inclination of 1:10 for better load-bearing capacity. Their thickness is less than that of H-beam flanges. The flanges of H-beams have equal thickness and are parallel to each other. They are longer, wider, and heavier than I-beams. The cross-section of H-beams is more optimized than I-beams, giving it a reasonable strength-to-weight ratio, i.e., more strength per unit area. They possess a greater surface area on the cross-section, hence high strength. I-beams are lightweight compared to H-beams. H-beams are heavier than I-beams. The moment of inertia of I-beams is less than H-beams, making them less efficient in resisting bending. The wider flanges of H-beams gain a greater moment of inertia and high lateral stiffness. Hence, they have better bending resistance than I-beams.

Various Exemplary Embodiments of the Invention

In a broad embodiment, the invention encompasses comprising an upright bollard element (1), welded or bolted to or passing through a base-plate (6) secured on the top surface of a foundation structure employing at least two H-beams (2) and (3) secured to each other at approximately in an approximately orthogonal orientation. Preferably, the upright bollard element (1) passes through the base-plate (6), continuing through the base-plate, and penetrating into the foundation structure such that the upright element is sandwiched between at least two H-beam elements, providing superior resistance to a force on the above-ground portion of the bollard.

In one embodiment the foundation structure employs H-beams. In another embodiment, I-beams may be used.

In a typical embodiment, H-beams may be welded or bolted (or both) together in a parallel or orthogonal orientation to one another.

In a typical embodiment, an upright bollard element is secured to the H-beam(s), either by bolting or by welding, or both, and a base-plate (6) of any shape, typically rectangular, is secured to the upper surface of the foundation structure to provide the surface onto which the upright bollard element is secured, or alternatively, through which the upright bollard element passes, continuing through the base-plate, and penetrating into the foundation structure such that the upright element is sandwiched between at least two H-beam elements.

The upright element is generally further attached to the baseplate (6) and reinforced by a plurality of buttresses (7) welded between the upright element and the baseplate.

In another typical embodiment, the H-beams include a plurality of pre-formed eye-holes (12) adapted to receive rebar rods.

In another typical embodiment, the H-beams include a plurality integrated eye-bolts (11) adapted to facilitate attachment of cables for carrying and moving the bollard system during transport and installation.

In certain embodiments the shape of the upright bollard element is round in cross-sectional area. In diameter it may be, for example 8 cm-40 cm, for example 10-30 cm or 10-20 cm in diameter. In other embodiments the upright bollard element may be square, rectangular triangular of a polygon in cross-section.

More than one upright bollard element may be present on one foundation, and these may be positioned such that they are separated or touching or bundled together.

In one embodiment the foundation may comprise a single H-beam. In others it may comprise two or more H-beams firmly attached together by welding or by bolting. The H-beams may be attached in a parallel fashion or attached orthogonally. Additionally, an X-shape or triangular or star-shaped arrangements are contemplated for the foundation element, with the key aspect being that the elements are made from commercial H-beams.

H-beams may be sourced in many sizes, dimensions and weights, See Machine-MGF at https://www.machinemfg-.com/h-beam-size-and-weight-chart/.

Any commercially available size of dimension is contemplated in this invention.

In one embodiment the dimensions of the foundation may be about 121 cm (about 48 inches) at its longest dimension (its length) and about 78 cm (31 inches) at its widest width and about 35 cm (14 inches) at its narrowest width. The range of length may be from about 50 to about 250 cm and the range of widest width may be from about 50 to 140 cm, and the range of narrowest width may be between 25 to 65 cm. The smallest dimensions will be dependent on the H-beam dimensions.

In one embodiment the number of elements of the foundation structure is one, comprising a single length of H-beam. To this single H-beam is affixed an upright bollard element. The upright bollard may be attached by welding or by bolting or both. The upright bollard may be affixed directly to the web of the H-beam or to the flange of the H-beam.

Alternatively, a base-plate may be attached to the H-beam, to the web (14), or to the flange (15), or welded across and in contact with two flanges, and the upright bollard may be attached to the base-plate or alternatively, it may pass through a hole in the base-plate penetrating into the foundation structure.

Buttress elements (7) may be used to strengthen the attachment of the upright element, being attached to both the upright element and to the base-plate (6) or to the H-beam. The foundation structure is adapted to be buried below the ground and the bollard is adapted to project above the ground.

The upright element, which may be round in cross-section (or any other suitable shape) may be hollow (defining a cylindrical internal void) may be internally reinforced by a crossbeam (8) inside the bollard pipe to improve resistance to impact forces and resist deformation of the upright element. The crossbeam may be made of steel or another metal. It may be x-shaped or may include any number of radial plates radiating from its central long axis, or indeed it may be made from a commercially available H-beam or I-beam of an appropriate size.

The hollow upright element may be filled, preferably but not necessarily, in situ, with a material that will add weight and therefore inertia, to the bollard.

The hollow upright element can be filled with a material, such as concrete.

Other materials that may be used to fill the hollow upright element include, for example, gravels, sands and silts, which are all incompressible. They may be present in a dry or a wet state within the bollard. If a moist mass of these materials is subjected to compression, they suffer no significant volume change. Clays may also be used, but are more compressible than sand or gravel. Compressibility of sand and silt varies with density and, compressibility of clay varies directly with water content and inversely with cohesive strength. Clays and other highly compressible soils are known to swell when overburden pressure is removed. Filling the upright element with water, which is highly incompressible, has the advantage of allowing easy emptying and refilling using a pump. Filling is generally done after the bollard has been placed in situ.

Holes (12) are provided in the H-beam to accept rebar for installation and Integrated eyebolts are provided for easy transport and installation.

In other embodiments the number of elements of the foundation structure is more than one, comprising two or more of H-beams (2) and (3), affixed to one another by bolts or welds or both. The plurality of H-beams forms the foundation, and to this foundation is affixed an upright bollard element. The upright bollard may be attached by welding or by bolting or both. The bollard may be affixed directly to the web of the H-beam or to the flange (15) of one or more H-beams.

Alternatively, a base-plate (6) may be attached to one or more H-beams, to the web, or to the flange, or welded across and in contact with two or more flanges, and the upright bollard may be attached to the base-plate or may pass through a hole in the base-plate into the foundation structure.

In a preferred embodiment shown in FIG. 1 and other drawings, the H-beams may set in a T-shape, with one H-beam orthogonal to another.

In the embodiment shown in FIG. 1 the bollard system comprises: one longer H-beam (a 'first H-beam') and one shorter H-beam (a 'second H-beam'), set in a T-shape, wherein the longer H-beam is positioned short-side on ("end on") to the long side of the shorter H-beam, as shown.

Each H-beam defines a length, a width and a height. The length is the longest dimension, the height is the second longest dimension and the width is the shortest dimension. Each H-beam has two ends. A first end and a second end.

The first and second H-beams, set in a T-shape, are attached to each other on bottom side of the structure via a (or via one or more) rectangular (but any shape may be used) lower plate ('connecting plate' or 'connector plate' or 'lower connector plate') (5) located on the bottom of the structure, partially overlapping and connected to both H-beams set in a T-shape, as shown. The steel plate is welded and/or bolted to the flanges of both the H-beams.

Note that in the figures, the lower connector plate is number (5). The base plate (6) is on top of the foundation structure and may approximately mirror the lower connector plate.

As can be seen in the figures, a rectangular lower connector plate (5) is flat and complete and has no hole within it and fits flush against the bottom of the first and second H-beams (2) and (3), and is attached directly to the flat bottom surface of one or more flanges (15) of both the H-beams.

The lower connector plate (5) may be referred to as 'bottom plate' or 'connecting plate' or 'connector plate' or 'lower connector plate'.

The base-plate (6) sits on top of the foundation, and may approximately mirror the lower connector plate. The base-plate has a hole in it, sized and adapted to receive the upright bollard element. The whole is round in many embodiments but could be square of any other shape to receive an upright member. The base-plate (6) is placed parallel to and above the flanges of the H-beams below, and is set apart from them by a small distance of a few centimeters (e.g., 1-20 cm, 1-10 cm or 5-15 cm). The base-plate is attached securely to flat top flanges of the H-beams below it by small connection plates (4) ('small plates' or 'small connector plates' or 'small connection plates'). The small connection plates (4) are orthogonally positioned between the base-plate and the flanges of the H-beams as shown in FIG. 1. That is to say that the small connection plates (4) meet the other surfaces at a right angle.

The number of steps in the manufacture of the bollard system of the invention are relatively few, because the elements are commercially available, pre-formed. This reduces manufacturing costs.

In one embodiment the materials used are all of forged steel. This includes steel alloys. In other embodiments some of the elements may be made from other materials such as iron, brass, carbon fiber, plastics, composite materials, etc.

The bollard system of the invention is designed specifically to meet the pre-set standards of the DoD and American Society for Testing and Materials, ASTM F2656, used to certify bollards that could withstand the from the ramming of various types of vehicles at different speeds. Specifically, the bollard system of the invention is designed to meet the Standard Test Truck (M): It will stop a 6800 kg (1500 lb.) truck travelling at 50 kmh (30 mph), 65 kmh (40 mph) and 80 kmh (50 mph) within a certain distance. Penetration Rating is set at one of the following performance standards:

P1=≤1 m (3.3 ft).;

P2=1.01–7 m (3.31 to 23.0 ft.);

P3=7.01–30 m (23.1 ft. to 98.4 ft.)

The DoD and ASTM ratings are determined by the weight of the vehicle and its maximum speed when it hits a barrier. For example, a M50/P1 crash barrier is designed to stop a Medium (M) Duty 15,000-pound truck traveling 50 mph with a penetration distance of <3.3 feet. The penetration rating indicates a barrier's performance to stop the forward movement of the vehicle load after impact. The shorter the testing vehicle's penetrating distance, the higher the barrier's performance level. P1 is the highest standard of performance.

The bollard of the invention was tested (non-publicly) on Feb. 16, 2022 using ASTM F2656-20 standard for M30 P1 impact condition designation. The bollard passed and met the required P1 standards, completely stopping a 15000 lb. truck, travelling at 30 mph in less than 3.3 ft.

Standard=ASTM

Rating=M30

Vehicle Weight=15,000 lbs.

Vehicle Speed=30 mph **P1, P2, P3

Penetration Rating=P1=≤1 m (3.3 ft

Specific embodiments include elements designed to strengthen the upright tubular element. As discussed above the upright element may include, set therein, a steel cross-beam (8). It may be filled with a relatively incompressible material such as water or sand. The upright may be a tube or a square or any other suitable shape in cross-section. Or may be formed of a solid piece such as an H-beam or an I-beam or a rod or bundle of rods bound together by steel bands. In al alternative embodiment the upright member is formed of more than one H-beam or I-beam such as two H-beams welded or bolted together either flange-to-flange or flange-to-web.

In one embodiment the bollard of the invention includes integrated sensors. Either wired or wireless, in functional communication with a computer system that is programmed to provide an alert to a user or to the public when the bollard is impacted. Impact sensors may be placed in the upright element of in the foundation element and will react to a programmed displacement or to a change in momentum. In other embodiments the bollard may comprise lights, electric power, signage etc. In another embodiment the upright element may be removeable and not permanently fixed to the foundation. In another embodiment the bollards may be provided as multiple elements projection across a line or entrance.

Installation and Use

To install the bollard, the bollard of the invention is placed in a pre-dug hole, rebar (17) is inserted through the eyeholes (12) before or after hole digging, and concrete (16) is poured into the hole, setting around the bollard system such that the upright elements projects above the ground, but the foundation structure is set in concrete below the ground. The orientation of the bollard system maximized resistance to impact force and the longest dimension is usually set in-line with the anticipated impact direction.

In use, the bollard, comprising the foundation structure and the upright bollard element, is installed into a pre-dug hole, below the grade of the ground. Rebar elements are inserted through a plurality pre-formed eye-holes within the foundation structure. Concrete is then poured around the structure to provide a secure subterranean foundation for the bollard system.

In our present invention, however, the H-beams are arranged in such a way as to place the center of gravity of the entire structure is underground and behind the above-ground upright element (1) relative to the crash/vehicle/impact direction. To clarify, looking at FIG. 1, the foundation is in the shape of a letter T. The 'front' of the bollard is defined as the side most closely facing the anticipated vehicle that is going to crash into the bollard and is the top bar of the T. The 'rear' of the bollard is defined as the side diametrically opposite to the front side. So to sat that the center of gravity is behind the above-ground upright element means that it is to the rear of the upright tube (on the tale of the T), and not in front of the upright tube. In use, the bollard system is placed in the ground such that the front faces the likely source of the impact, and the back faces away from the impact.

The bollard of the invention is designed so that the center of gravity is underground and behind the above-ground upright element (see FIG. 1).

The arrangement allows the bollard to meet crash rated specifications without adding additional weight (and therefore cost) to the structure and without the necessity to dig a deeper foundation. Specifically, the present invention is designed to use a shallow foundation hole to avoid utilities or other underground obstacles. This is a very important aspect of the invention because it hugely reduces costs.

Our design (M30-SM "shallow mount" bollard) requires 700 mm (27.6") of concrete below grade, while our "non-shallow mount" bollard needs only 900 mm (35.4").

To clarify, our design (M30-SM) is adapted to be installed no more than 700 mm below grade, and our "non-shallow mount" system is adapted to be installed no more than 900 mm (35.4") below grade.

Thus, the total depth of the bollard system below the ground may be 700 mm in one embodiment or 900 mm in another embodiment.

In a preferred embodiment (the one tested), the foundation is entirely below grade (ground level) and the top of the triangular buttresses (7) are not visible because they are below grade, and the top of the triangular buttresses may be defined as the top of the foundation structure, with only the vertical tube element (1) being visible above grade.

In another embodiment, the triangular buttresses (7) may be visible above grade and the base-plate (6) can be defined as the ground level.

In another embodiment the triangular buttresses (7) are welded below the base-plate in contact with the vertical element (1) and the bottom of the base-plate (6).

General Representations Concerning the Disclosure

This specification incorporates by reference all documents referred to herein and all documents filed concurrently with this specification or filed previously in connection with this application, including but not limited to such documents which are open to public inspection with this specification. All numerical quantities mentioned herein include quantities that may be plus or minus 20% of the stated amount in every case, including where percentages are mentioned. As used in this specification, the singular forms "a, an", and "the" include plural reference unless the context clearly dictates otherwise. Thus, for example, a reference to "a part" includes a plurality of such parts, and so forth. The term "comprises" and grammatical equivalents thereof are used in this specification to mean that, in addition to the features specifically identified, other features are optionally present. For example, a composition "comprising" (or "which comprises") ingredients A, B and C can contain only ingredients A, B and C, or can contain not only ingredients A, B and C but also one or more other ingredients. The term "consisting essentially of" and grammatical equivalents thereof is used herein to mean that, in addition to the features specifically identified, other features may be present which do not materially alter the claimed invention. All weights, lengths, distances and other quantities described may be +/−10% or +/−20%. The term "at least" followed by a number is used herein to denote the start of a range beginning with that number (which may be a range having an upper limit or no upper limit, depending on the variable being defined). For example, "at least 1" means 1 or more than 1, and "at least 80%" means 80% or more than 80%. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Where reference is made in this specification to a method comprising two or more defined steps, the defined steps can be carried out in any order or simultaneously (except where the context excludes that possibility), and the method can optionally include one or more other steps which are carried out before any of the defined steps, between two of the defined steps, or after all the defined steps (except where the context excludes that possibility). When, in this specification, a range is given as "(a first number) to (a second number)" or "(a first number)-(a second number)", this means a range whose lower limit is the first number and whose upper limit is the second number. For example, "from 40 to 70 microns" or "40-70 microns" means a range whose lower limit is 40 microns, and whose upper limit is 70 microns.

The invention claimed is:

1. An individual, stand-alone bollard designed to decelerate and stop a vehicle impacting said bollard; comprising:

a single upright element (1), inserted into and passing through a base-plate (6) which is secured onto the top surface of a foundation structure, wherein the foundation structure comprises two H-beams (2) and (3), each made from a one-piece extruded metal form, oriented with respect to each other in a T-shape, wherein the two H-beams are placed such that, in situ, the web of each H-beam is in a vertical orientation, and wherein the two H-beams have an upper surface defined by flanges and a lower surface defined by flanges, wherein the two H-beams are connected to each other via at least one lower connector plate (5), which fits flush against the bottom of the foundation structure, partially overlapping and connected to the flanges of the lower surface of both H-beams, and wherein the base-plate (6) is positioned above the flanges of the upper surface of the two H-beams, so as to be to be partially overlapping and connected to the top side of both H-beams via a plurality of small rectangular connection plates (4) that are orthogonally positioned between the base-plate and the flanges of the H-beams.

2. The bollard of claim 1 wherein the base-plate has a hole disposed within said baseplate, sized and adapted to receive the upright element, and wherein the lower connector plate does not have a corresponding hole in it.

3. The bollard of claim 1 wherein the upright element has a round cross-sectional shape.

4. The bollard of claim 1 wherein the upright element passes through the base-plate such that said upright element penetrates into the foundation structure such that a portion of the upright element is sandwiched between the two H-beams.

5. The bollard of claim 1 wherein welds or bolts connect the H-beams to the base-plate and the lower connector plate.

6. The bollard of claim 1 further comprising a plurality of buttresses (7) welded between the upright element (1) and the base-plate (6).

7. The bollard of claim 1 further comprising a plurality of eye-holes (12) within the H-beams, adapted to receive rebar rods.

8. The bollard of claim 1 further comprising a plurality of integrated eye-bolts (11) adapted to facilitate attachment of cables for carrying and moving the bollard system during transport and installation.

9. The bollard of claim 1 wherein the baseplate is spaced 1 cm to 15 cm above the top of the H-beams and connected to the H-beams via a plurality of rectangular connection plates (4).

10. The bollard of claim 1 wherein the upright element (1) is internally reinforced.

11. The bollard of claim 1 wherein the upright element is internally reinforced by a crossbeam extending within the upright element.

12. The bollard of claim 1 wherein the upright element is internally reinforced by an H-beam or I-beam.

13. The bollard of claim 1 wherein the upright element is filled with concrete.

14. The bollard of claim 1, wherein the H-beam is made from a one-piece extruded form.

15. The bollard of claim 1 wherein the upright element (1) is inserted into and passes through a base-plate (6) such that at least 30% of the upright element is present below the base-plate.

16. The bollard of claim 1 wherein the upright element is permanently fixed to the base-plate and to the lower connector plate by welds.

* * * * *